US009587358B2

(12) United States Patent
Roy

(10) Patent No.: US 9,587,358 B2
(45) Date of Patent: Mar. 7, 2017

(54) POTHOLE REPAIR PRODUCT AND MOBILE APPARATUS AND METHOD OF MANUFACTURING AN ASPHALT PATCH

(71) Applicant: GESTION ACBK INC., St-Alphonse de Granby (CA)

(72) Inventor: Andre Roy, St-Alphonse de Granby (CA)

( * ) Notice: Subject to any disclaimer, the term of this patent is extended or adjusted under 35 U.S.C. 154(b) by 0 days.

(21) Appl. No.: 14/438,393

(22) PCT Filed: Oct. 24, 2013

(86) PCT No.: PCT/CA2013/050804

§ 371 (c)(1),
(2) Date: Apr. 24, 2015

(87) PCT Pub. No.: WO2014/063252

PCT Pub. Date: May 1, 2014

(65) Prior Publication Data

US 2015/0259864 A1 Sep. 17, 2015

(30) Foreign Application Priority Data

Oct. 24, 2012 (CA) ..... 2793350

(51) Int. Cl.
*E01C 19/45* (2006.01)
*E01C 23/06* (2006.01)
(Continued)

(52) U.S. Cl.
CPC ..... *E01C 19/45* (2013.01); *C10C 3/007* (2013.01); *E01C 7/18* (2013.01); *E01C 7/187* (2013.01); *E01C 7/22* (2013.01); *E01C 11/005* (2013.01); *E01C 19/002* (2013.01); *E01C 19/08* (2013.01); *E01C 19/1004* (2013.01); *E01C 19/104* (2013.01); *E01C 19/1063* (2013.01); *E01C 19/463* (2013.01); *E01C 23/06* (2013.01); *E01C 2019/1081* (2013.01)

(58) Field of Classification Search
CPC ..... E01C 19/45; E01C 19/002; E01C 19/08; E01C 19/1004; E01C 19/104;
(Continued)

(56) References Cited

U.S. PATENT DOCUMENTS 3,217,620 A * 11/1965 Mindrum ..... E01C 19/285 173/185
4,196,827 A * 4/1980 Leafdale ..... E01C 19/08 222/146.2

(Continued)

*Primary Examiner* — Abigail A Risic
(74) *Attorney, Agent, or Firm* — Norton Rose Fulbright Canada LLP

(57) ABSTRACT

A mobile apparatus for the repair of potholes in an asphalt paved surface comprises first storage bin for the containment of recycled shingle particles or recycled asphalt or combinations thereof. A first conveyor is provided for conveying the particles from the first storage bin to an inlet of a radiant heated transport mixing conveyor. A second storage bin is provided for the containment of stone aggregate. A second conveyor conveys and pre-heats the stone aggregate to the inlet of the transport mixing conveyor. An oil reservoir has a pump at an outlet thereof for feeding a predetermined quantity of asphaltic oil at the inlet of the mixing conveyor. The mixing conveyor has vanes for displacing, mixing and heating the stone aggregate, the recycled asphalt particles or recycled asphalt and the asphaltic oil to produce an asphalt patch material and feeding same to a dispensing outlet.

18 Claims, 8 Drawing Sheets

(51) Int. Cl.

| | |
|---|---|
| ***C10C 3/00*** | (2006.01) |
| ***E01C 19/10*** | (2006.01) |
| ***E01C 7/18*** | (2006.01) |
| ***E01C 11/00*** | (2006.01) |
| ***E01C 19/00*** | (2006.01) |
| ***E01C 7/22*** | (2006.01) |
| ***E01C 19/08*** | (2006.01) |
| ***E01C 19/46*** | (2006.01) |

(58) Field of Classification Search
CPC ..... E01C 19/1063; E01C 19/463; E01C 7/18; E01C 7/187; E01C 7/22; E01C 11/005; E01C 23/06
See application file for complete search history.

(56) References Cited

U.S. PATENT DOCUMENTS 4,874,283 A * 10/1989 Hurley, Jr. ..... E01C 23/06 239/675
5,069,578 A * 12/1991 Bense ..... E01C 11/005 404/75
5,333,969 A * 8/1994 Blaha ..... E01C 19/46 404/102
5,988,935 A * 11/1999 Dillingham ..... E01C 23/06 404/101
6,681,761 B2 * 1/2004 Dillingham ..... E01C 19/08 126/312
7,654,772 B1 * 2/2010 Zimmerman ..... E01C 19/1054 404/101
8,016,516 B2 * 9/2011 Johnson ..... E01C 23/06 404/108
8,931,975 B2 * 1/2015 Warlow ..... B01F 7/00433 404/108
2004/0022119 A1 * 2/2004 McIntosh ..... B01F 7/04 366/26
2004/0240939 A1 * 12/2004 Hays ..... E01C 19/182 404/95
2006/0198701 A1 9/2006 Hall
2010/0040412 A1 2/2010 Fickeisen
2013/0058719 A1 * 3/2013 Warlow ..... B01F 7/00433 404/92

* cited by examiner 19
47
50
48
30
18''
18'
18
49
50
46'
22
42
43'
45'

40
41
29
46
42
15
40
41
45
43
44'
41

41
44
29

POTHOLE REPAIR PRODUCT AND MOBILE APPARATUS AND METHOD OF MANUFACTURING AN ASPHALT PATCH

TECHNICAL FIELD

The present invention relates to a mobile apparatus for the repair of potholes in asphalt paved surfaces and the method of manufacturing an asphalt patch material using recycled asphalt shingles or recycled asphalt or combinations thereof.

BACKGROUND ART

Methods and apparatus for the manufacturing of asphalt material for paving road surfaces are well known. It is also known to utilize waste roofing shingles for admixture with asphalt whereby large quantities of these shingles can be recycled. These waste shingles are usually discarded in dumps where it presents both an ecological and environmental problem. Designated dump areas are also provided wherein very large quantities of this material are buried in the soil. It is known to utilize asphaltic waste material for the use of molding other asphaltic products such as battery cases or waterproof containers, etc.

In the manufacture of asphalt, virgin aggregate material which is comprised of crushed rock, small rock and sand is heated and dried in a rotating drum. Asphalt oil is utilized with various penetration numbers and which is also heated usually in the range of 280 to 350° F. The heated aggregate is then mixed with the liquid asphalt in a proportion typically of 5 to 6 percent asphalt by weight. The paving composition is then hauled in large quantities in trucks to the job site and dumped into a paving vehicle. However, when repairing potholes only, the vehicle transporting the asphalt needs to be displaced at many locations to fill these potholes. Because the asphalt is not dispensed in large quantities from the trucks, the asphalt will cool down during the day and lose its elastic property and form large clumps. To overcome this problem, very small vehicles with small loads of asphalt are utilized for pothole filling but because the work is time consuming the asphalt still cools down. This necessitates the vehicle to effect a limited job and to go back to an asphaltic plant several times in a day to reload with hot asphalt to continue repairing potholes. This is an expensive time-consuming operation.

SUMMARY OF INVENTION

It is therefore a feature of the present invention to provide a mobile apparatus for the repair of potholes in an asphalt paved surface and a method of manufacturing an asphalt patch material containing recycled asphalt products such as shingles or recycled asphalt or combinations thereof and wherein the manufacturing is effected directly on the mobile apparatus to provide an asphalt patch material having a substantially constant controlled temperature and elasticity for patching potholes.

Another feature of the present invention is to provide a mobile apparatus and method for the repair of potholes in an asphalt paved surface and using an asphalt patch material which contains recycled asphalt products such as shingles or recycled asphalt or combinations thereof and wherein the mobile apparatus can operate continuously during long time periods without having to reload any recycled asphalt shingle particles and stone aggregate material as well as asphaltic oil and wherein the mixture is effected on the mobile vehicle which is self-sufficient.

According to the above features, from a broad aspect, the present invention provides a mobile apparatus for the repair of potholes on roadways. The apparatus comprising a motorized vehicle on which is mounted a first storage bin for the containment of recycled asphalt products in particle form, such as asphalt shingle particles of a predetermined size range or recycled asphalt. A first conveyor means is provided for conveying the particles or recycled asphalt or combinations thereof from the first storage bin to an inlet end of a heated transport mixing conveyor. A second storage bin is provided for the containment of stone aggregate of a predetermined size range. A second conveyor means is provided for conveying and pre-heating the stone aggregate for delivery to said inlet end of said heated transport mixing conveyor. An asphaltic oil reservoir having a pump at an outlet thereof for feeding a predetermined quantity of the asphaltic oil at the inlet end of the heated transport mixing conveyor. The heated transport mixing conveyor has conveying means for displacing, mixing and heating the stone aggregate, the recycled asphalt particles or recycled asphalt or combinations thereof and the asphaltic oil to produce an asphalt patch material and feeding same to a dispensing outlet of the mixing conveyor. The control means controls the operation of the first and the second conveyor means, the pump and the radiant heated transport chamber.

According to a further broad aspect of the present invention there is provided a method of manufacturing an asphalt patch material on a mobile vehicle and using recycled asphalt products in particle form, such as asphalt shingle particles or recycled asphalt for patching potholes on roadways, said method comprising the steps of: (i) storing in a first storage bin recycled asphalt particles of a predetermined size range or recycled asphalt or combinations thereof on said mobile vehicle, (ii) storing in a second storage bin a stone aggregate of a predetermined size range on said mobile vehicle, (iii) pre-heating said stone aggregate in said second storage bin, (iv) providing a heated transport mixing conveyor having an inlet end and a dispensing outlet, (v) conveying said recycled asphalt particles or recycled asphalt to said inlet end, (vi) conveying said pre-heated stone aggregate to said inlet end for discharge simultaneously with said recycled asphalt particles or recycled asphalt or combinations thereof in a predetermined ratio, (vii) simultaneously with steps (v) and vi) feeding an asphaltic oil from an oil reservoir on said mobile vehicle to said inlet end in a predetermined ratio, and (viii) operating said heated transport mixing conveyor to displace, mix and heat said stone aggregate with said recycled asphalt particles or recycled asphalt or combinations thereof and said asphaltic oil to produce said asphalt patch material and feeding same to said dispensing outlet.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
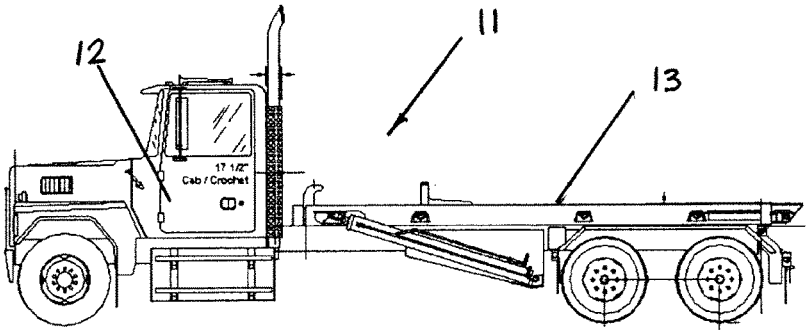
FIG. 1 is a side view of a mobile vehicle capable of transporting all of the equipment of the present invention necessary for the manufacture of the asphalt patch material.
Figure 2:
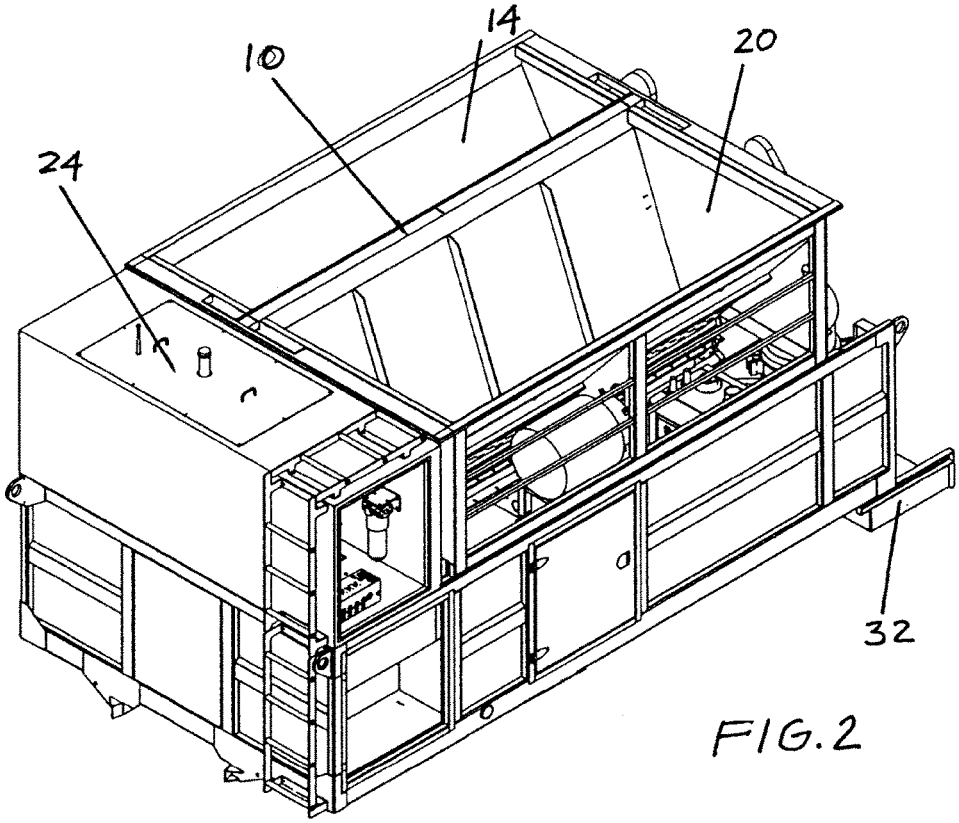
FIG. 2 is a perspective view illustrating the main component parts of the asphalt patch material manufacturing equipment for support on the mobile vehicle as shown in FIG. 1.
Figure 3:
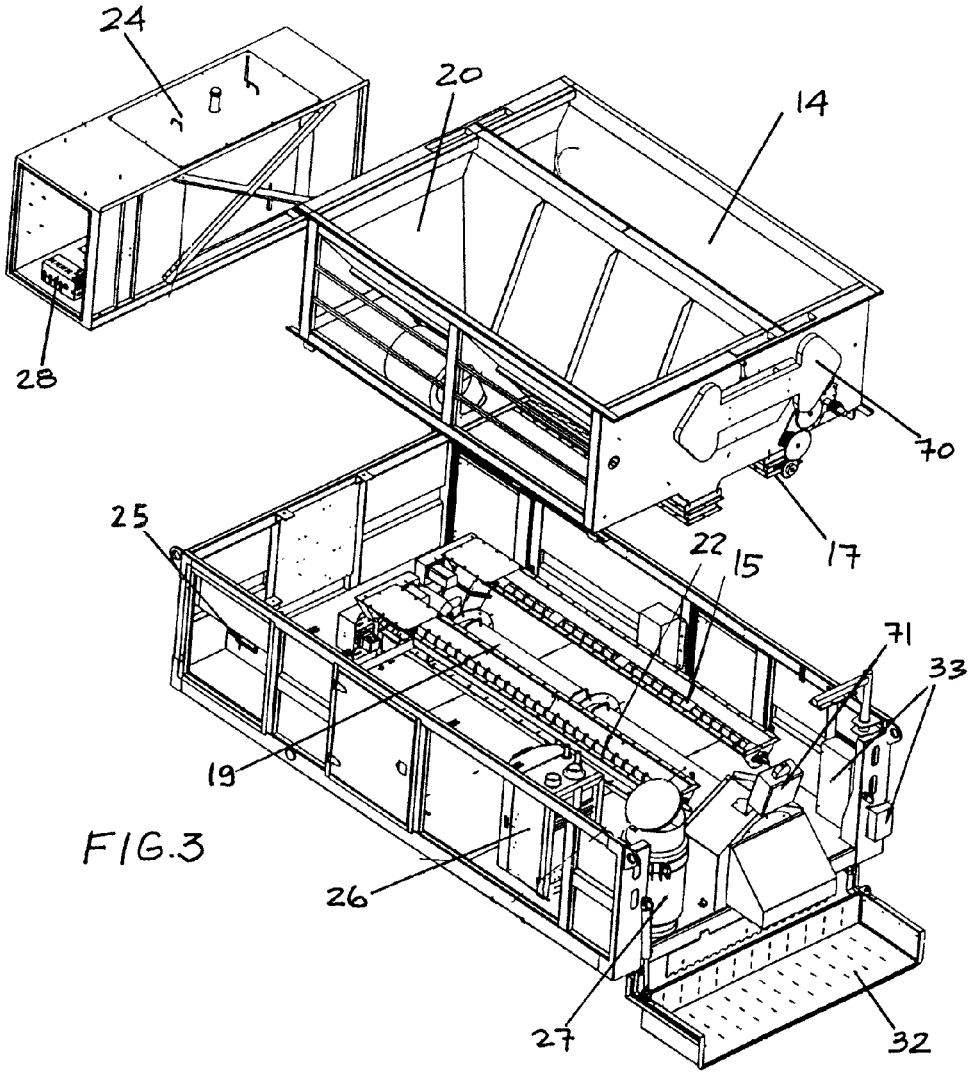
FIG. 3 is an exploded view of the equipment showing the main component parts thereof secured in modules.

A preferred embodiment of the present invention will now be described with reference to FIGS. 1 to 3. The asphalt patch material manufacturing apparatus 10 of the present invention is mounted on a flatbed truck 11 which is a motor vehicle having a cab section 12 and a support platform 13. As hereinshown the support platform 13 is an articulated platform connected to the motor vehicle frame but it may consist of a flatbed which is immovably secured to the frame. As shown in FIG. 3, the apparatus 10 is constructed in modules frames for ease of installation on the truck and for maintenance and repair.

With reference to FIGS. 2 to 12, there is shown the basic component parts of the apparatus 10 for the manufacture of the asphalt patch material. The apparatus consist of a first storage bin 14 for containment of recycled asphalt shingle particles 16 of predetermined size range or recycled asphalt or combinations thereof. The asphalt particles are formed from recycled asphalt shingles of other asphalt materials that can be cut to particle size and which are hashed or cut into small pieces of approximately from 10 to 25 mm in size. The description makes reference to recycled asphalt shingle particles but it is to be understood throughout the description that such may be replaced by recycled asphalt or combinations thereof.

A first conveyor, herein a screw conveyor 15, transports these recycled asphalt shingle particles 16 from a discharge opening 17 at the bottom of the first storage bin 14 to an inlet opening 18 of a radiant heated transport mixing conveyor 19. A second storage bin 20 is provided for the containment of stone aggregate of a predetermined size range. Typically this aggregate is comprised of crushed stone and sand particles having a size up to ¼ inch. The bottom part of the second storage bin 20 has radiant heating plates 51 secured thereto to heat the aggregate. This heated aggregate 21 is discharged at a lower end thereof into a second screw conveyor 22 which is heated. This heated aggregate is then discharged in the inlet opening 18' of the radiant heated transport mixing conveyor 19, see FIG. 12, for admixture in predetermined quantities with the recycled asphalt particles 16.

Figures 8, 9:
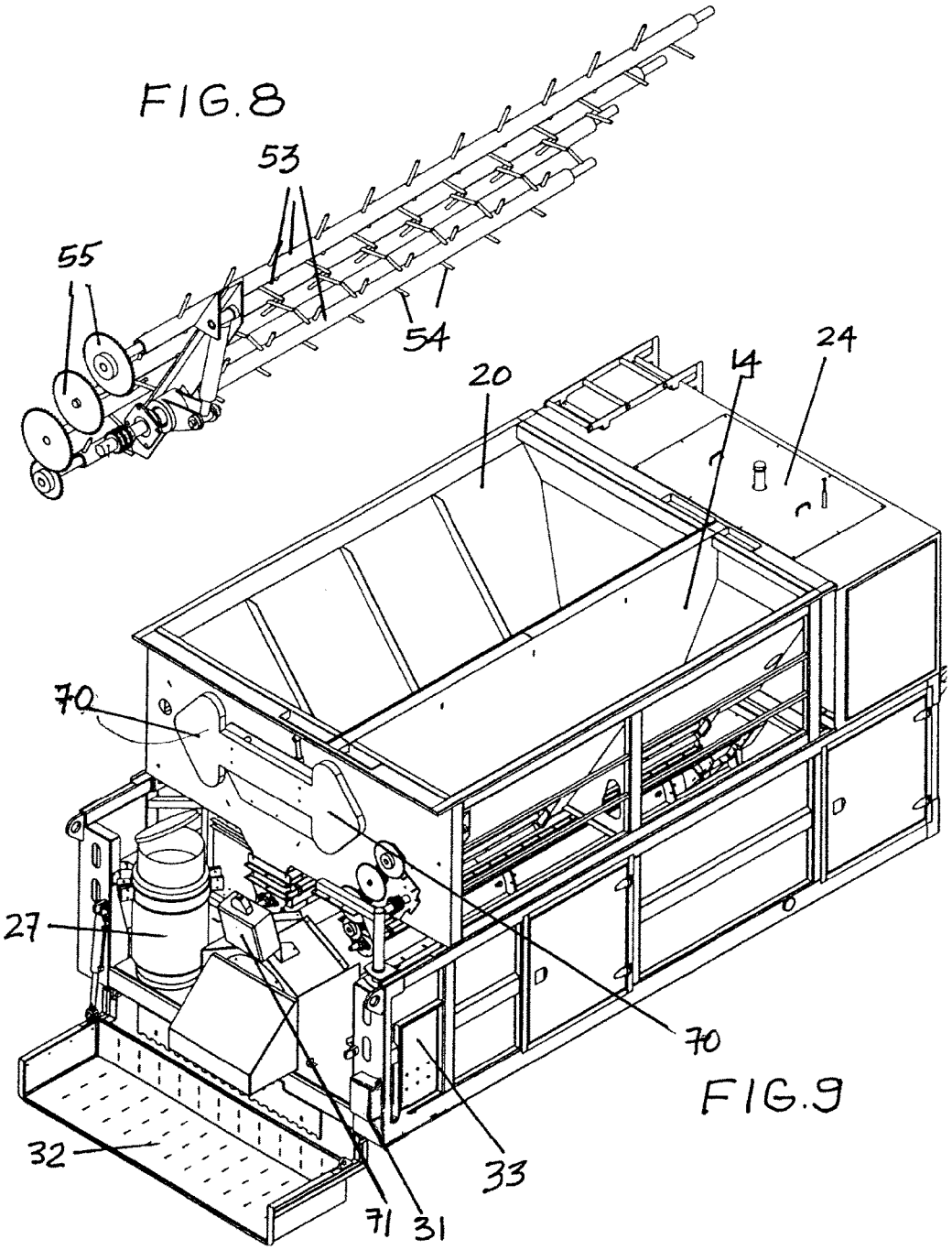
FIG. 8 is a perspective view of the asphalt particles mixing mechanism and their drive.
FIG. 9 is a rear perspective view of the apparatus showing component parts thereof.
Figures 10, 11, 12:
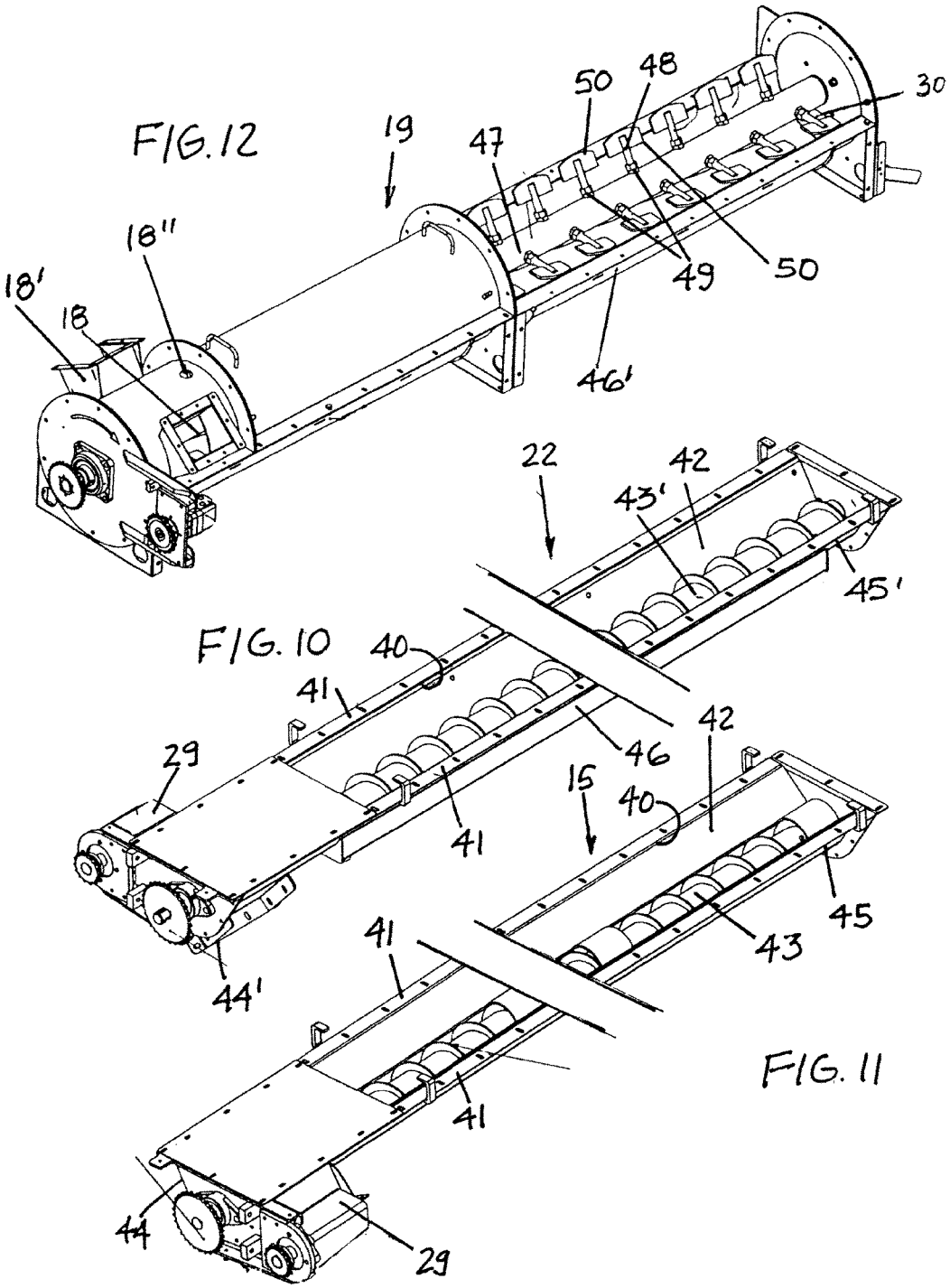
FIG. 10 is a perspective fragmented top view of the aggregates screw conveyors.
FIG. 11 is a perspective fragmented top view of the asphalt particles screws conveyor.
FIG. 12 is a top perspective view, part of which is exposed showing the construction of the mixing conveyor.

The apparatus also comprises an asphaltic oil reservoir 24 which is provided with a pump 25 at its outlet and which pump is controlled by a control circuit associated with control panel 33 to dispense a predetermined quantity of the asphaltic oil for admixture with the recycled asphalt shingle particles 16 and the heated aggregate 21 through an inlet 18", as shown in FIG. 12. The radiant heated transport mixing conveyor 19 is heated by recirculating a hot liquid in a coil circuit provided in a jacket, as will be described later. This heated liquid is heated by a gas burning water heater 26 which is fed propane gas from a pressurized container 27. A hydraulic control system 28 operates the motors 29 of the screw conveyors and is also operated by a control circuit, not shown, and accessed through the control panel 33. The control panel 33 also controls the operation of the oil pump 25 whereby there is a proper ratio of the asphalt oil with the recycled asphalt shingle particles. Aggregate and asphaltic oil is fed at the inlet 18 of the radiant heated mixing conveyor 19. Accordingly, at the dispensing outlet 30 of the radiant heated mixing conveyor a substantially constant temperature asphalt patch material can be delivered. The control 31 is manually operated by personnel to provide the proper quantity of material discharged at the dispensing outlet 30. As shown in FIG. 9, a hinge platform or thraugh 32 receives the asphalt patch mixture which is then shoveled off by working personnel to fill potholes. A hood 32' shields the dispensing outlet 30.

Figure 5:
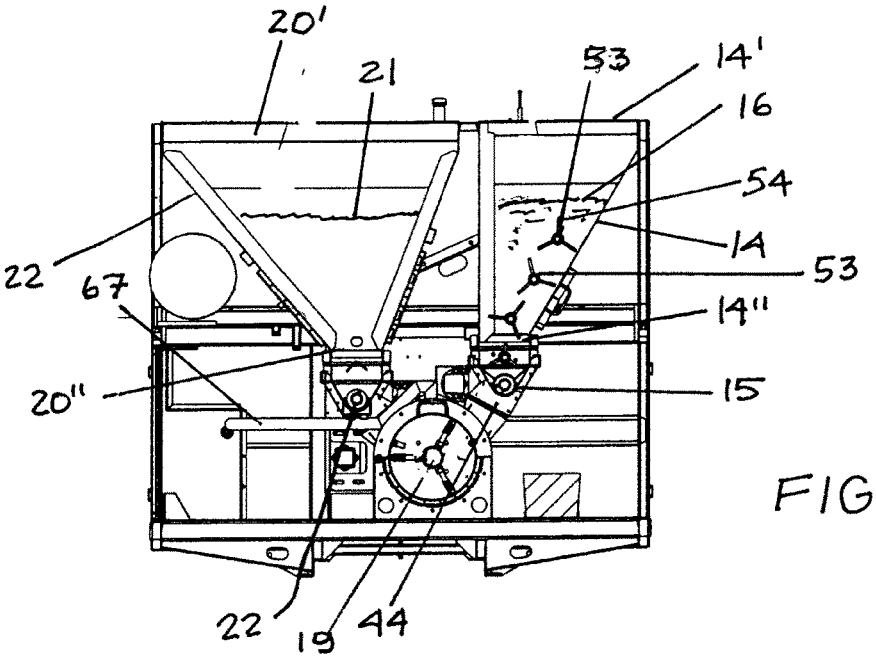
FIG. 5 is a section view along cross-section lines 5-5 of FIG. 4.

FIG. 5 is a section view illustrating the construction of the dispensing storage bins 14 and 20 wherein it can be seen that the bins have an open top end 20' and 14' to permit the loading of the recycled asphalt shingle particles and the aggregate. This loading is effected by a front end loading vehicle, not shown but obvious to a person skilled in the art. As also illustrated herein, and in FIGS. 1 and 11, the screw conveyors are of cylindrical shape. The position of the screw conveyors is also illustrated in FIG. 3 and is secured under the bins which are of trough shape with the materials gravitating towards the bottom open discharge end of the bins.

With further reference to FIGS. 10 and 11, there is shown the construction of the screw conveyors 15 and 22. They both have a large open top end section 40 which is secured to a bottom open end 14" and 20" of their respective bins 14 and 20 whereby asphalt shingle particles and aggregate will sit into their respective inlet trough 42 on top of their screws 43 and 43'. The material is displaced towards their outlet ends 44 and 44', respectively of their casings 45 and 45'.

With reference to FIGS. 5, 10 and 11, it can be seen that the asphalt particle screw conveyor 15 and the aggregate screw conveyor 22 are secured under the bottom open end 14" and 20" of their respective bins. This securement is provided by flanges 41 provided on opposed sides on the open end 40 of the screws conveyors. As shown in FIG. 10, the aggregates screw conveyor 22 is provided with a radiant heating jacket 46 in which are disposed channels through which hot liquid is circulated by means of the pump 25 whereby to maintain the aggregate at a desired temperature for binding with the asphalt oil and asphalt particles. As shown in FIG. 12, the radiant heated mixing conveyor 19 is also provided with a heated casing 46' through which hot liquid circulates to maintain the conveyor enclosure at a desired temperature. Material discharged in the inlet openings 18 and 18' is mixed and conveyed from the inlet openings to the dispensing outlet 30 by means of mixing paddles 50 which are secured to a rotatable shaft 47 to which the mixing paddles are secured by adjustable rods 48. The rods 48 are threaded in the shaft 47 and locked with the paddles 50 disposed at an angular position by lock nuts 49. The angle of the mixing paddles 50 conveys the material from the inlets 18 and 18' to the dispensing outlet 30. As the mixed material is conveyed through the mixing conveyor 19 the material is maintained at a substantial desired temperature. The control panel 33 and control circuits make it possible to control the speed of the mixing conveyor to assure the delivery of asphaltic patch material in a desired temperature range. The speed of the shaft 47 is also controlled to provide the proper mixture and temperature of the asphaltic patch material and the dispensing volume.

Figure 6:
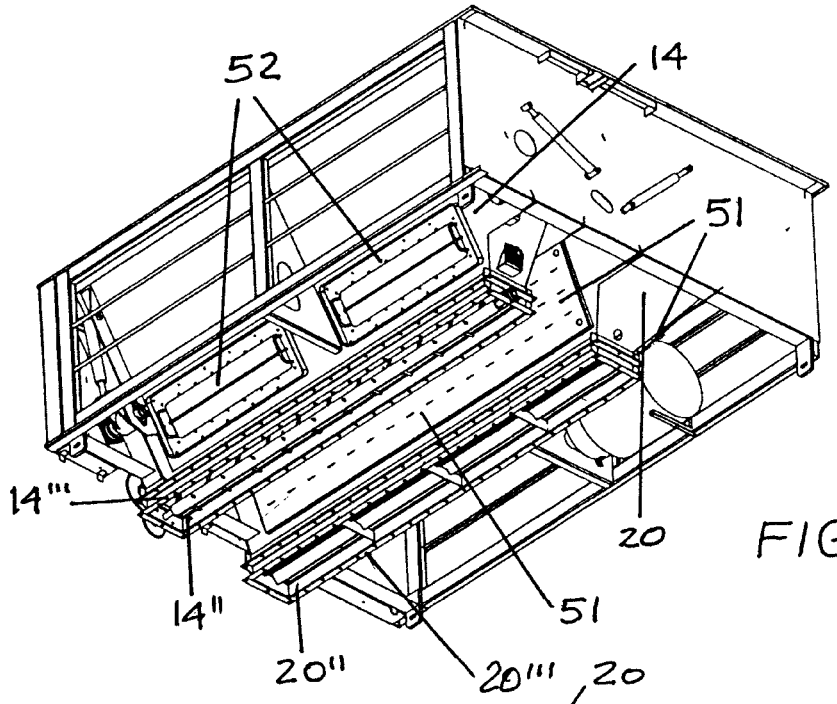
FIG. 6 is a bottom view of the storage bins support frame showing the position of the heating panels.

With reference to FIG. 6, there is shown the construction of the heated plates. As hereinshown, large heated plates 51 are secured to the bottom section of the aggregate bin 20. A pair of heated plates 52 is also secured to the bottom end section of one of the thraugh walls of the asphalt particles bin 14. As also hereinshown the bottom open ends 14" and 20" of the bins are provided with circumferential flanges 14''' and 20''' for securement to the flanges 41 of the screw conveyors 15 and 22.

Figure 7:
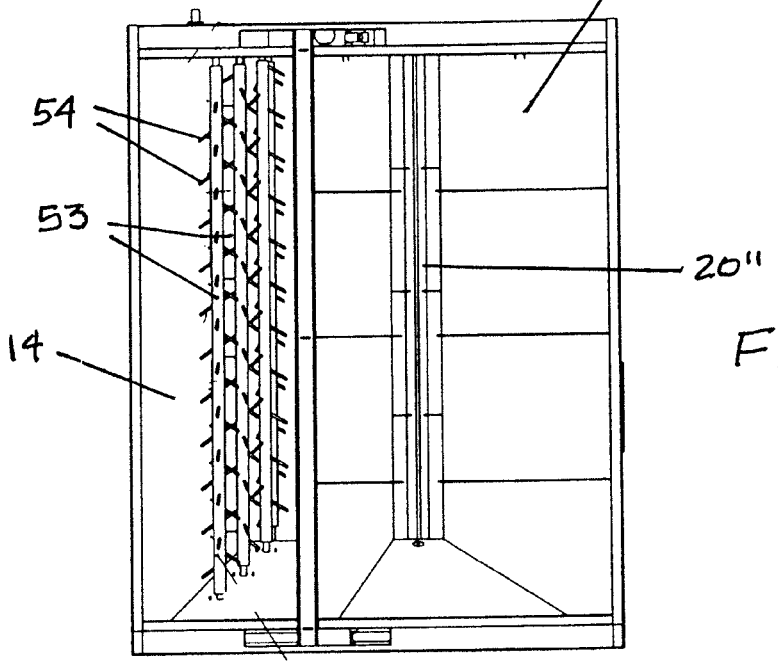
FIG. 7 is a top view of the storage bins support frame showing the asphalt shingle particles mixing mechanism.

With further reference to FIGS. 5, 7 and 8, it can be seen that the asphalt particle bin 14 is also provided with a series of spaced horizontal mixing rods 53 which are rotatably driven by a conventional chain link drive. The rods are provided with sprocket wheels 55 to which is secured the chain drive. Not shown herein, but obvious to persons skilled in the art, a motor drives the mixing rods which are continuously rotated to assure proper mixing of the asphalt particle mixture to prevent these particles from bonding to one another to form large clumps of these particles. These mixing rods are coated with a non-stick material and have angularly protruding fingers 54 which intermingled with one another to provide thorough mixing. These mixing rods provide 9000 lbs. per inch of force to provide for proper mixing of the heavy load of the asphalt shingle particles.

Figure 4:
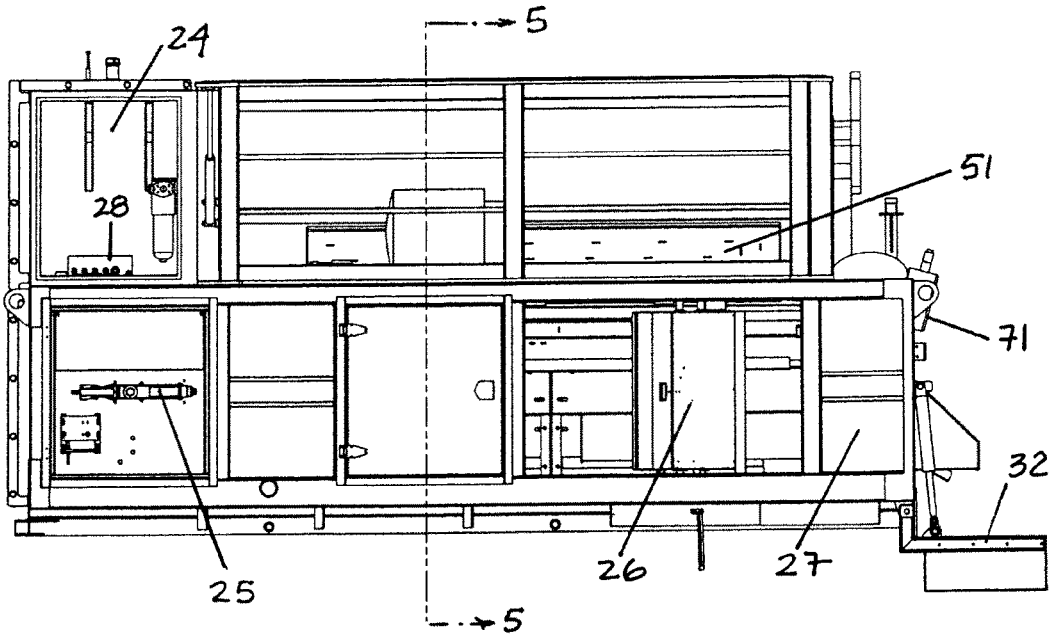
FIG. 4 is a side view of the manufacturing module for the asphalt patch material.
Figure 13:
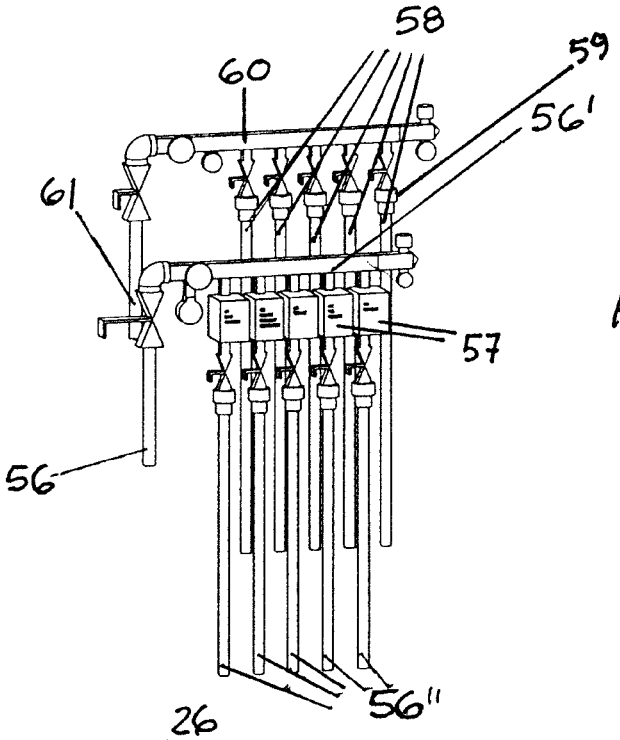
FIG. 13 is a perspective view illustrating the controls associated with the thermal heating conduits.
Figure 14:
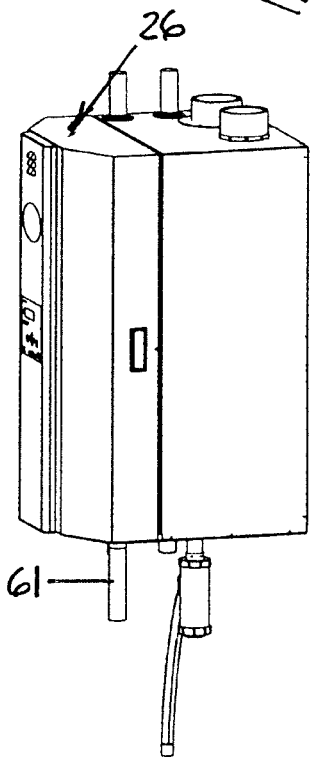
FIG. 14 is a perspective view showing the gas heater associated with the thermal heating conduits of FIG. 13.

With reference to FIGS. 13 and 14, there is shown the control system for the hot water circulated in the heating jackets of the bins as well as the aggregates screw conveyor housings and the mixing conveyor housing. As shown in FIG. 4, a propane gas water heater 26 is provided and connected in a conduit loop. The propane gas heater 26 provides hot water to the inlet pipe 56 of the distribution manifold 56' which feeds hot water to the various heated circuits herein represented by conduits 56". All of these distribution conduits 56" have a solenoid operated valve 57 whereby to control the flow of hot water to the various heating jackets or panels associated with the apparatus. Water returned conduits 58 are also operated by valve 59 and feed a manifold 60 wherein cooler returned water is fed to pipe 61 and into the propane gas heater to be heated. The temperature of the water is controlled by the control circuit which operates the water circulating pump. The gas reservoir 27 supplies the propane gas water heater 26 as previously described.

Figure 15:
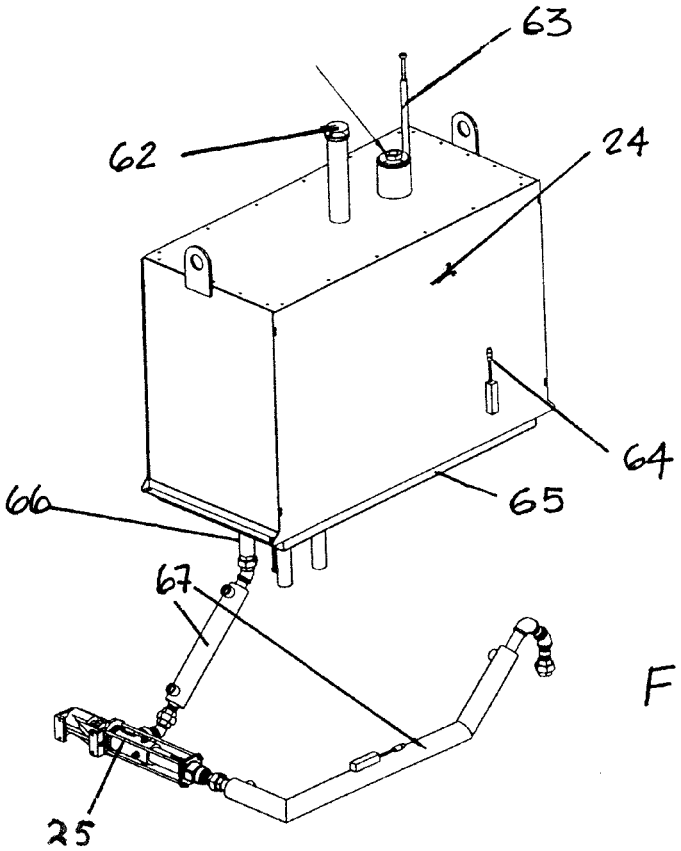
FIG. 15 is a perspective view of the asphaltic oil reservoir and its associated parts including its pre-heating tubes and pump.

With reference to FIG. 15, there is shown the assembly of the asphaltic oil reservoir 24. The reservoir has an inlet pipe 62 and a mechanical level sensor 63 secured in the top wall of the reservoir. A temperature gauge 64 is appropriately located to sense the temperature of the asphaltic oil in the reservoir. A heating plate 65 is provided under the reservoir to maintain the asphaltic oil at a desired temperature. The outlet feed pipe 66 is secured to the bottom end of the reservoir and feeds the heated oil to the inlet end 18" of the mixing conveyor 19. The oil is fed through heating tubes 67 and the oil is circulated by the oil pump 25. The oil is maintained at a temperature between 80 to 130° C. The heating liquid which is circulated in the heating plates and jacket is maintained at a temperature of between 60 to 80° C. The heating liquid may be glycol which is more suitable when the apparatus is utilized in cold weather conditions. It is also pointed out that the control of these temperatures can be effected remotely depending on local temperature conditions through GPS communication.

As shown in FIG. 9 the rear of the apparatus 10 is provided with a directional signal panel 70 which is operated by the controls 33 to signal to oncoming traffic from the rear to move to a desired side of the transport vehicle. A screen 71 also provides information to the personnel working behind the vehicle. A suitable battery pack is also provided to provide d.c. power. The control panels at the rear of the vehicle provide a convenient location for operating personnel for proper operation of the apparatus. Also, the quantity of asphaltic material and aggregate is calculated whereby there is a sufficient quantity for the mobile vehicle 11 to effect a full day's work patching potholes on designated roadways. The apparatus as above described and illustrated is provided with two operator persons, one to drive the truck and the other to fill the potholes and compact the asphaltic patch material therein.

It is also within the ambit of the present invention to provide an automatic asphalt dispensing and patching mechanism secured to the outlet of the mixing conveyor 19 and secured to the frame of the apparatus whereby to automatically fill and compact paddles. A camera would be utilized in such an installation to align the automatic asphalt filler and compacting mechanism of the type known in the art. Such can also be operated remotely through a GPS communication link. It is also pointed out that the vibration of the vehicle during its travel also causes the materials in the bins 14 and 20 to propagate towards the bottom discharged openings of the bins. The asphaltic patch material is discharged from the mixing conveyor 19 at a temperature of approximately 100° C.

It is further pointed out that in order to utilize the mobile apparatus during cold periods, a thermally insulated enclosure may be constructed around the radiant heated transport chamber, the aggregate material conveyor. The asphaltic oil reservoir and pump and other parts of the system requiring thermal insulation.

In summary, the mobile asphaltic patch material using recycled asphalt particles, such as shingle particles, comprises the essential steps of storing recycled asphalt shingle particles 16, of a predetermined size rage in a storage bin 14. Stone aggregate material 21 of predetermined size usually 0-¼ inch is stored in a further storage bin 20. A radiant heated mixing conveyor 19, provided with an inlet end 18 and a dispensing end 30, is mounted on the mobile vehicle. The recycled asphalt shingle particles 16 are heated and conveyed to the inlet end 18 of the radiant heated mixing conveyor 19. The stone aggregate material 21 is also preheated, conveyed and discharged at the inlet end 18 of mixing conveyor 19 simultaneously with the recycled asphalt shingle particles, in a predetermined ratio as determined by the speed of operation of the screw conveyors. Simultaneously with this mixture, heated asphaltic oil is fed therein from an oil reservoir on the mobile vehicle. The heated screw conveyor 22 and the radiant heated mixing conveyor 19 are heated by a hot liquid circulated in coils provided in plates or jackets. A gas burner water heater provides the heating of the circulated liquid. The radiant heated mixing conveyor 19 is operated to displace, mix and heat the stone aggregate with the recycled asphalt shingle particles and the asphaltic oil to produce at an outlet thereof an asphalt patch material at a predetermined temperature range for use in patching potholes.

A typical example of the mixture would comprise 50% by weight of recycled asphalt shingle particles, 25% by weight of aggregate and 25% by weight of asphaltic oil.

It is also pointed out that other examples of mixtures can be utilized depending on the specific properties of the materials. The recycled asphalt shingle particles may also comprise other asphalt roofing materials in admixture therewith. It is also pointed out that shingles manufactured subsequent to 1980 typically consist of 25% asphalt, 25% fiberglass and 50% granular/filler material.

In a further embodiment the shingle particles may be replaced by recycled asphalt.

It is within the ambit of the present invention to cover any obvious modifications of the preferred embodiment described herein, provides such modifications fall within the scope of the appended claims.

The invention claimed is:

1. A mobile apparatus for the repair of potholes on roadways, said apparatus comprising a motor vehicle on which is mounted a first storage bin for the containment of asphalt particles of a predetermined size range, the first storage bin having a heater for pre-heating the asphalt particles; a first conveyor for conveying said asphalt particles from said first storage bin to an inlet end of a heated transport mixing conveyor, a second storage bin for the containment of stone aggregate of a predetermined size range, the second storage bin having a heater for pre-heating the stone aggregate, a second conveyor having a radiant heating jacket for conveying and pre-heating said stone aggregate for delivery to said inlet end of said heated transport mixing conveyor, the first storage bin, the second storage bin and the heated transport mixing conveyor being independently heated, an asphaltic oil reservoir having a pump at an outlet thereof for feeding a predetermined quantity of said asphaltic oil at said inlet end of said heated transport mixing conveyor; said heated transport mixing conveyor having conveying means for displacing, mixing and heating said stone aggregate, said asphalt particles and said asphaltic oil to produce an asphalt patch material and feeding same to a dispensing outlet of said mixing conveyor; and control means for controlling the operation of said first and second conveyors, said pump and said heated transport mixing conveyor.

2. A mobile apparatus as claimed in claim 1 wherein said heater of said second storage bin is secured to at least a lower region of the second storage bin.

3. A mobile apparatus as claimed in claim 2 wherein said first conveyor and said second conveyor are cylindrical screw conveyors having an inlet opening in a top end thereof for receiving therein said asphalt particles and said aggregate respectively.

4. A mobile apparatus as claimed in claim 1 wherein said inlet opening of said first and second screw conveyors are elongated opening disposed along elongated discharge troughs of said first and second storage bins.

5. A mobile apparatus as claimed in claim 1 wherein said heater of the second storage bin includes radiant thermal heating plates provided by heating conduits in heat exchange relationship with at least one side wall of said second storage bin, and a heated liquid circulated in said heating conduits.

6. A mobile apparatus as claimed in claim 1 wherein said heater of the first storage bin comprises heating plates secured to at least a lower region of the first storage bin for heating said asphalt particles.

7. A mobile apparatus as claimed in claim 1 wherein said first storage bin is provided with mixing and agitating rods provided at different elevations in the first storage bin to prevent said asphalt particles from conglomerating together, said asphalt particles being preheated prior to be disposed in said first storage bin, the rods having protruding fingers which are intermingled with one another.

8. A mobile apparatus as claimed in claim 1 wherein said heated transport mixing conveyor is an elongated cylindrical conveyor, said conveying means being comprised by a central drive shaft provided with adjustable mixing and conveying paddles angulated to displace and mix said aggregate, said asphalt particle and said asphaltic oil from said inlet end to said dispensing outlet.

9. A mobile apparatus as claimed in claim 1 wherein said asphaltic oil reservoir is a heated reservoir, and heated conduit means associated with said pump for delivery of heated oil to said inlet end of said heated transport mixing conveyor.

10. A mobile apparatus as claimed in claim 1 wherein there is further provided an asphalt patch material support platform adjacent said dispensing outlet for supporting a predetermined quantity of said asphalt patch material for access thereto by one or more pothole filing person.

11. A mobile apparatus as claimed in claim 1 wherein said first and second storage bins, said second conveyor and said heated transport mixing conveyor are provided with hot water radiant heaters; a gas heater heating a liquid circulated in a closed conduit loop, a plurality of valves for segmenting said conduit loop into sub-conduit loops, said valves being controlled by said control means.

12. A mobile apparatus as claimed in claim 1 wherein there is further provided an hydraulic system connected to hydraulic motors for operating said screw conveyor and said transport mixing conveyor though chain driven sprocket wheels.

13. A method of manufacturing an asphalt patch material on a mobile vehicle and using recycled asphalt products in particle form, such as asphalt shingle particle or recycled asphalt for patching potholes on roadways, said method comprising the steps of:

i) storing in a first storage bin recycled asphalt particles of a predetermined size range or recycled asphalt or combinations thereof on said mobile vehicle, ii) storing in a second storage bin a stone aggregate of a predetermined size range on said mobile vehicle, iii) independently pre-heating at least a portion of said recycled asphalt particles or recycled asphalt and said stone aggregate in said first and second storage bins, respectively, iv) providing a heated transport mixing conveyor having an inlet end and a dispensing outlet, v) conveying said pre-heated recycled asphalt particles or recycled asphalt to said inlet end of said mixing conveyor, vi) conveying said pre-heated stone aggregate to said inlet end of said mixing conveyor for discharge simultaneously in said inlet end with said recycled asphalt particles or recycled asphalt in a predetermined ratio, vii) simultaneously with steps v) and vi) feeding an asphaltic oil from an oil reservoir on said mobile vehicle to said inlet end of said mixing conveyor in a predetermined ratio, and viii) operating said heated transport mixing conveyor to displace, mix and heat said stone aggregate with said recycled asphalt particles or recycled asphalt or combinations thereof and said asphaltic oil to produce said asphalt patch material and feeding same to said dispensing outlet for use in patching said potholes.

14. A method as claimed in claim 13 wherein said step (i) further comprises using a plurality of vertically spaced-apart agitators for mixing and agitating said recycled asphalt particles or recycled asphalt in said first storage bin.

15. A method as claimed in claim 13 wherein said step (vi) further comprises heating said pre-heated stone aggregate as it is being conveyed to said inlet end of said mixing conveyor.

16. A method as claimed in claim 13 wherein prior to step (vii) there is further provided the step of heating said asphaltic oil.

17. A method as claimed in claim 13 wherein there is further provided the step of heating a liquid in a recirculating conduit circuit equipped with control valves to provide radiant heating of said first and second storage bins, said mixing conveyor, a conveyor for said pre-heated stone aggregate said oil reservoir, radiant heated plates of said first and second storage bins and a rear platform.

18. A method as claimed in claim 13 wherein after step (viii) there is provided the step of discharging said asphalt patch material from said dispensing outlet onto a support platform at a rear of said mobile vehicle for access thereto by one or more pothole filing person.

* * * * *